United States Patent [19]

Omori et al.

[11] Patent Number: 4,652,713

[45] Date of Patent: Mar. 24, 1987

[54] INDUCTION HEATING APPARATUS USING INDUCTIVE COUPLING FOR CURRENT REGULATION

[75] Inventors: Hideki Omori, Kawanishi; Kazuhiko Asada, Kyoto; Hideyuki Kominami, Takatsuki, all of Japan

[73] Assignee: Matsushita Electric Industrial Co., Ltd., Kadama, Japan

[21] Appl. No.: 817,721

[22] Filed: Jan. 10, 1986

[30] Foreign Application Priority Data

Jan. 14, 1985 [JP] Japan ..... 60-4279

[51] Int. Cl.[4] ..... H05B 6/08

[52] U.S. Cl. ..... 219/10.77; 219/10.49 R; 363/97

[58] Field of Search ..... 219/10.77, 10.75, 10.49 R; 323/222; 363/21, 97, 98

[56] References Cited

U.S. PATENT DOCUMENTS

| | | | |
|---|---|---|---|
| 3,569,817 | 3/1971 | Boehringer | 323/222 |
| 3,882,370 | 5/1975 | McMurray | 219/10.77 X |
| 4,426,564 | 1/1984 | Steigerwald et al. | 219/10.77 |
| 4,530,043 | 7/1985 | Palm et al. | 323/222 X |

*Primary Examiner*—Philip H. Leung

*Attorney, Agent, or Firm*—Cushman, Darby & Cushman

[57] ABSTRACT

An induction heating apparatus comprises a heating coil and a transistor which is connected to a direct current power source in series thereto to form an inverter for converting the direct current to an alternating current, and furthermore, a first coupling coil for supplying a forward base current to the transistor is coupled with the heating coil inductively and a second coupling coil for supplying a inverse base current for the transistor is also coupled to the heating coil inductively, and the inverter is controlled by a switching device which is controlled by a control circuit.

17 Claims, 8 Drawing Figures

INDUCTION HEATING APPARATUS USING INDUCTIVE COUPLING FOR CURRENT REGULATION

FIELD OF THE INVENTION AND RELATED ART STATEMENT

1. FIELD OF THE INVENTION

The present invention relates generally to an induction heating apparatus, and more particularly to a driving circuit of a power transistor of an inverter circuit thereof.

2. DESCRIPTION OF THE RELATED ART

A well known circuit of an induction heating apparatus in accordance with the prior art is shown in FIG. 1. In FIG. 1, output ends of direct current power sources (hereafter referred to as power sources) 71 and 72 are connected in series, and a junction 79 therebetween is connected to a ground. Electric powers for a first switching device 73 is supplied by the power source 71, and electric powers for a second switching device 74 is supplied by the power source 72. The collector of the first switching device 73 is connected to the collector of the second switching device 74 through a current limitation resistor 76. The junction point 81 of the transistor 74 and the resistor 76 is connected to a base of a transistor 70 which is a device of an inverter 80. A control circuit 75 controls turn-on or turn-off of the first switching device 73 and the second switching device 74. A positive terminal of a power source 77 is connected to the collector of the transistor 70 through a heating coil 78, and a negative terminal is connected to the ground. A forward base current for the transistor 70 is supplied by the power source 71 through the first switching device 73 and the resistor 76, and an inverse base current is supplied by the power source 72 through the second switching device 74. The transistor 70 is controlled by alternate conductive states of the first switching device 73 and the second switching device 74, and the inverter 80 oscillates an alternating current.

In this induction heating apparatus of the prior art, a large sized resistor 76 and two large-sized switching devices, such as power transistors are required for the first switching device 73 and the second switching device 74. Hence, the cost of production is expensive. Furthermore, efficiency of the induction heating apparatus is lower due to energy loss in the resistor 76.

Furthermore, considerably large power sources are required for the first power source 71 and the second power source 72. The power sources are large in size and heavy in weight, because the first power source 71 and the second power source 72 generally include transformers, and rise in cost is inevitable.

The negative terminal of the power source for the control circuit 75 is generally connected to the ground with the emitter of the transistor 70. Therefore, level of an output signal of the control circuit 75 is higher than that of the emitter voltage of the transistor 70, and a level shift circuit 88 for shifting the level of the output signal is required to drive the second switching device 74. In another prior art, in order to solve the above-mentioned problem, a current transformer 85 is inserted in the collector circuit of the transistor 70 as shown in FIG. 2. In such second prior art, output signals of the control circuit 75 are applied to the transistor 70 through the current transformer 85. Nevertheless the current transformer is expensive, voluminous and heavy in weight.

OBJECT AND SUMMARY OF THE INVENTION

An object of the present invention is to provide a small size, light weight, high efficiency and inexpensive driving circuit.

An other object of the present invention is to provide a small size, light weight, high efficiency and inexpensive induction heating apparatus using the above-mentioned control circuit.

Induction heating apparatus in accordance with the present invention comprises:

an inverter including a heating coil and a transistor connected in series to a direct current power source for converting a direct current from the direct current power source into an alternating current, a forward base current supply circuit having a control circuit for controlling operation of the inverter and a first coupling coil coupled inductively to the heating coil, an inverse bias voltage generating circuit having a second coupling coil coupled inductively to the heating coil, a rectifier and filter means, and a switching device for controlling the transistor.

DESCRIPTION ON THE PREFERRED EMBODIMENTS

Figure 1:
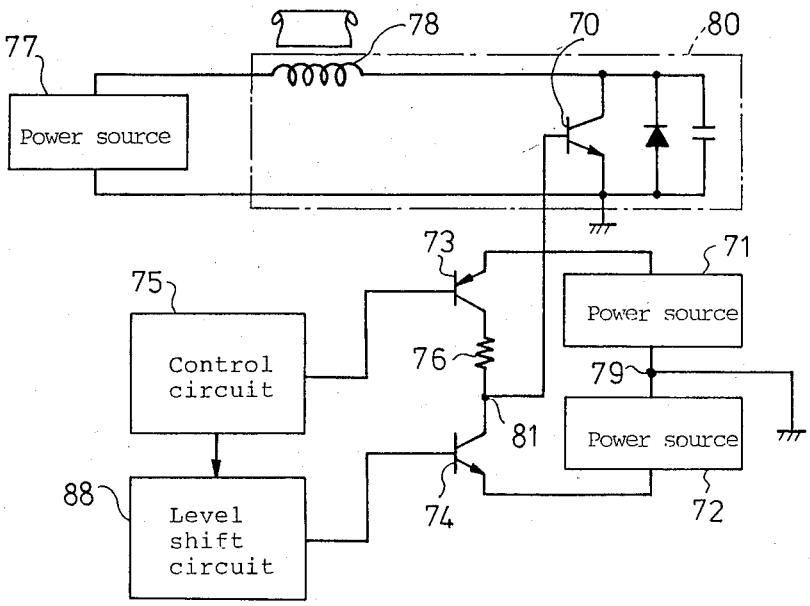
FIG.1 (Prior Art)
FIG. 1 is the circuit diagram of the typical induction heating apparatus in the prior art.
Figure 2:
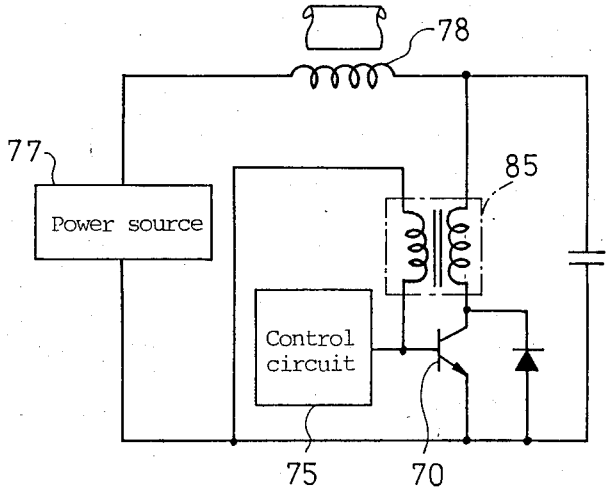
FIG.2 (Prior Art)
FIG. 2 is the circuit diagram of the other induction heating apparatus in the prior art.
Figure 3:
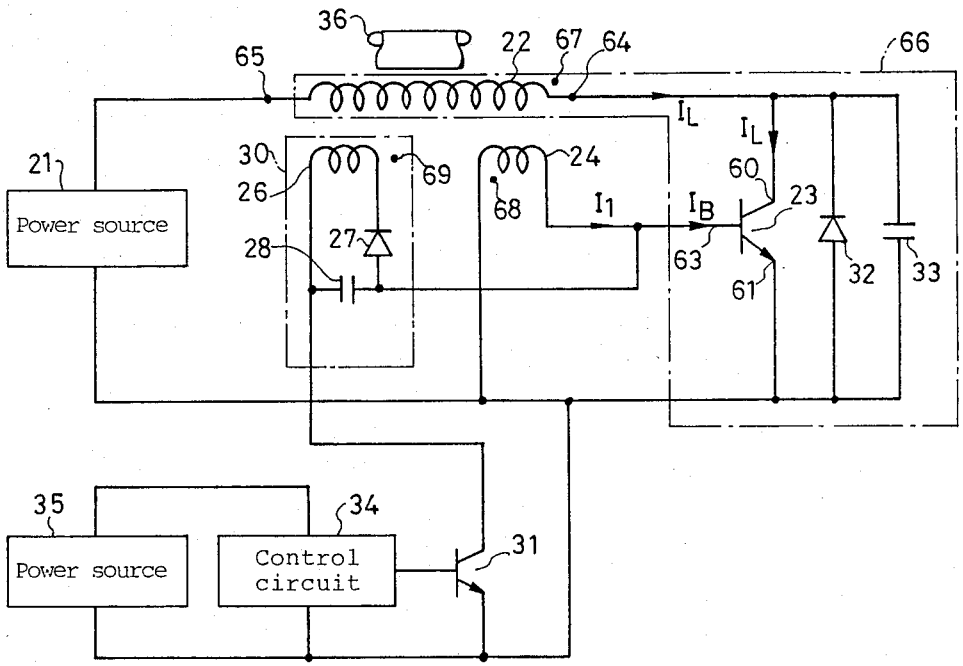
FIG. 3 is a circuit diagram of a first embodiment of an induction heating apparatus in accordance with the present invention.

A circuit diagram of a first embodiment of an induction heating apparatus in accordance with the present invention is shown in FIG. 3. A positive terminal of a direct current power source 21 (hereafter referred to as a power source) is connected to a terminal 65 of a heating coil 22. The other terminal 64 of the heating coil 22 is connected to the collector 60 of a transistor 23. A negative terminal of the power source 21 is connected to the emitter 61 of the transistor 23. A diode 32 and a resonance capacitor 33 are connected in parallel to the transistor 23. An inverter circuit 66 is formed by the above-mentioned heating coil 22, the transistor 23, the diode 32 and the resonance capacitor 33. A first coupling coil 24 is coupled inductively to the heating coil 22 for supplying a forward base current to the transistor 23. One of two terminals of the first coupling coil 24 is connected to the base of the transistor 23, and the other terminal is connected to the negative terminal of the power source 21. A second coupling coil 26 is also coupled inductively to the heating coil 22. One of terminals of the second coupling coil 26 is connected to the collector of a power transistor 31 which works as a switching device, and the other terminal is connected to the base of the transistor 23 through a rectifier diode 27. A capacitor 28 is connected between the base of the transistor 23 and the collector of the switching device 31. An inverse bias voltage generating circuit 30 for a inverse bias voltage of the transistor 23 is formed by the second coupling coil 26, the rectifier diode 27 and the capacitor 28 for a filter. A control circuit 34 controls the inverter circuit 66 through the power transistor 31. A power source 35 supplies a DC power to the control circuit 34. A pan 36 is put above the heating coil 22.

Figure 4:
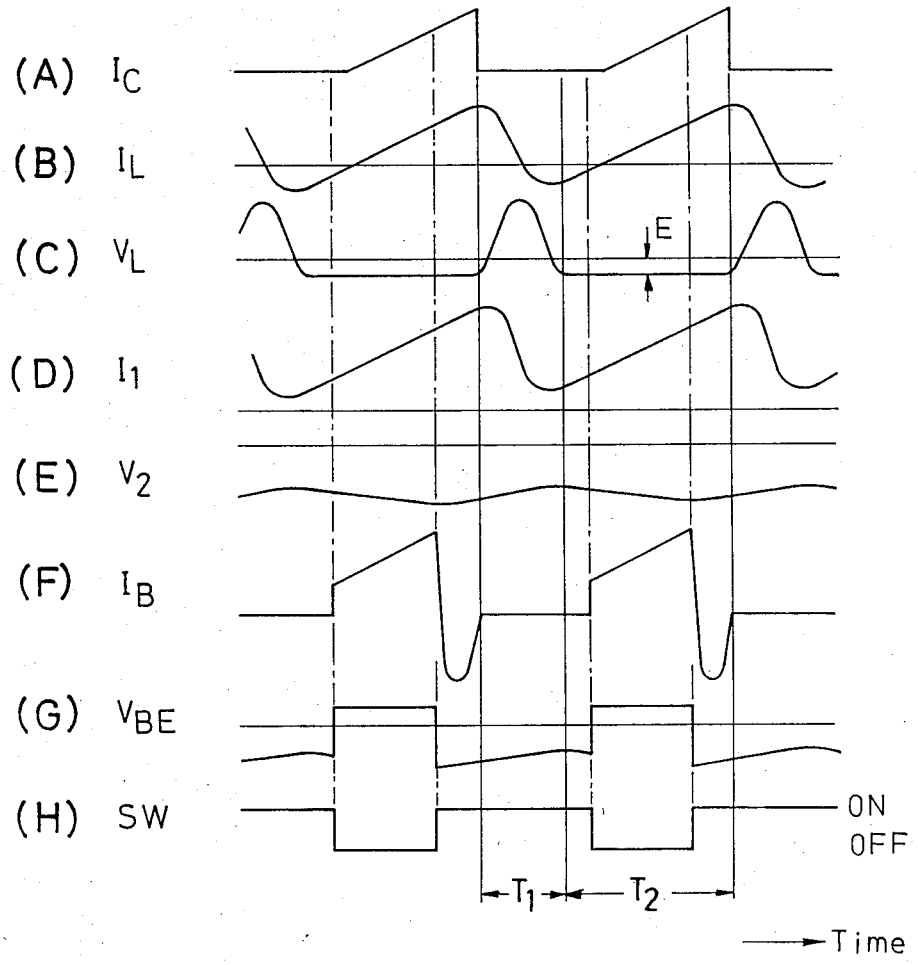
FIG. 4 is a timing chart for showing operations of the first embodiment of the induction heating apparatus.

Wave forms showing operations of the induction heating apparatus of the first embodiment are shown in FIG. 4. In FIG. 4, a wave form (A) shows collector currents $I_C$ of the transistor 23. A wave form (B) shows currents $I_L$ of the heating coil 22. A wave form (C) shows voltages applied to the heating coil 22. Wave forms (D) and (E) show output currents $I_1$ from the first coupling coil 24 and output voltages $V_2$ from the inverse bias voltage generating circuit 30, respectively. Wave forms (F) and (G) show base currents $I_B$ of the transistor 23 and voltages $V_{BE}$ between the emitter 61 and the base 63, respectively. A wave form (H) shows operation of the switching device 31, and therein high levels show an ON state and low levels show an opened state of the switching device 31. The transistor 23 keeps off-state in a time period ($T_1$) and keeps on-state in a time period ($T_2$).

Since the first coupling coil 24 is used as a current transformer, the current $I_1$ shown by the wave form (D) is in proportion to the current $I_L$ as shown by the wave form (B). Furthermore the second coupling coil 26 is used as a voltage transformer, and a voltage $V_2$ which is in proportion to the voltage $V_L$ shown by a wave form (C) are induced in the second coupling coil 26, and the wave form (C) $V_L$ is changed to the wave form (E) by the rectifier diode 27 and the capacitor 28.

When the switching device 31 is operated by the control circuit 34 as shown in the wave form (H), the base voltage $V_{BE}$ of the transistor 23 is operated as shown in FIG. 4(G). The collector current $I_C$ of the transistor 23 is operated by inductance of the heating coil 22 as shown in FIG. 4(A). The wave form of the current $I_L$ which is shown in FIG. 4(B) is formed by the chargings and dischargings of the capacitor 33. Dots 67, 68 and 69 in FIG. 3 show the coupling direction of the respective coils to each other. When the respective coils are coupled as shown by the dots 67, 68 and 69 in FIG. 3, the output currents $I_1$ of the second coupling coil 24 increase corresponding to increase of the current $I_C$. As a result, loss in the transistor 23 in the ON state decreases because enough forward base current is supplied. On the other hand, the output voltage $V_2$ of the inverse bias voltage generating circuit 30 is in proportion to the voltage E of the power source 21 and is not influenced by the kind or heat capacity of the pan 36 and the output current of the inverter circuit 66. If the current $I_1$ and $I_L$ flow by a noise during the ON period of the power transistor 31, since the direction of the current which generates in the second coupling coil 26 is opposite to the current $I_1$, the current $I_1$ flow into the second coupling coil 26. Therefore, base currents $I_B$ for the transistor 23 can be stopped when numbers of turns of the first coupling coil 24 and the second coupling coil 26 are selected appropriately. As a result, the operation of the induction heating device can be made stable. In case that the power transistor 31 hold ON state in order to stop the inverter 66 for a fairly long period, for instance, one second, the output voltage $V_2$ of the inverse bias voltage generating circuit 30 become zero rapidly. Therefore, no such a large current flow as in a case where the constant voltage power source is used for the inverse bias voltage generating circuit. Since one terminal of the power transistor 31 is connected to the emitter of the transistor 23 and the ground terminal of the control circuit 34, a level shift circuit is unnecessary.

Figure 5:
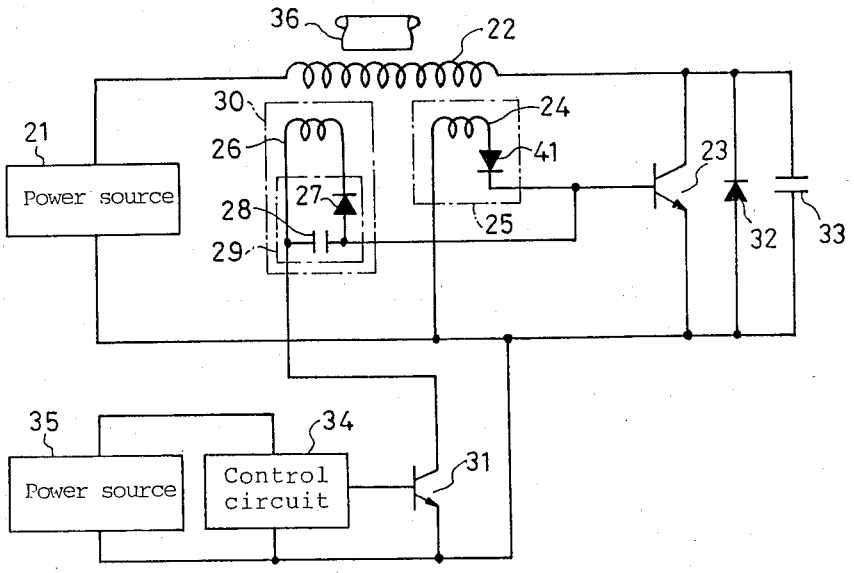
FIG. 5 is a circuit diagram of a second embodiment of the induction heating apparatus in accordance with the present invention.

A second embodiment of the induction heating apparatus in accordance with the present invention is shown in FIG. 5. In this embodiment, a rectifier diode 41 is inserted between the first coupling coil 24 and the base 63 of the transistor 23, and a forward base current supply circuit 25 is formed together with the control circuit 34. Other parts of the circuit of the second embodiment are similar to those of the first embodiment. When the transistor 23 becomes OFF state by unexpected noise in an OFF period of the switching device 31, a high inverse voltage is generated in the first coupling coil 24, and it is feared that the transistor 23 is damaged by reception of high voltage surge between the emitter 61 and base 63. The above-mentioned danger is prevented by the rectifier diode 41 in this embodiment.

Figure 6:
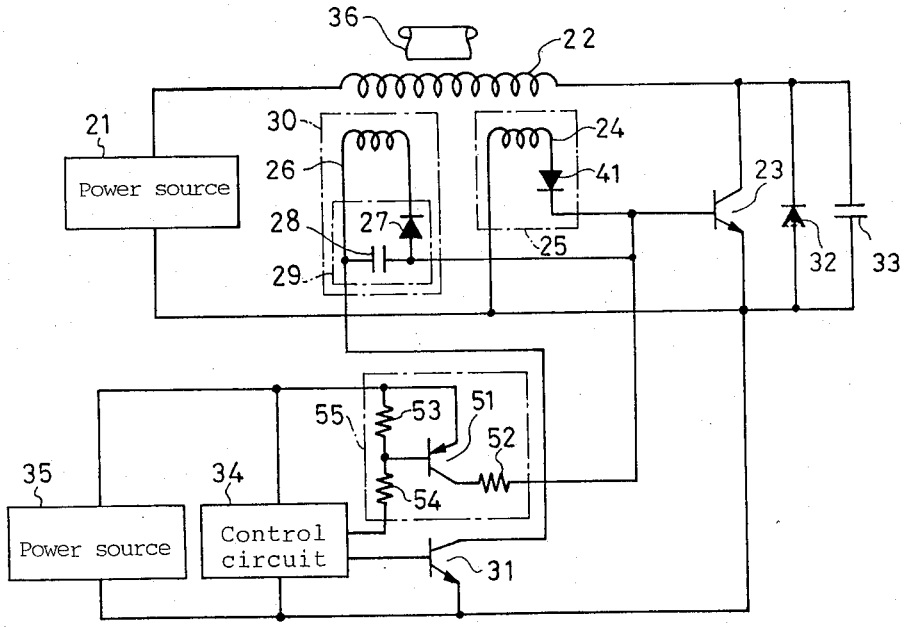
FIG. 6 is a circuit diagram of a third embodiment of the induction heating apparatus in accordance with the present invention.

A third embodiment of the induction heating apparatus in accordance with the present invention is shown in FIG. 6. In this embodiment, a starting circuit 55 is inserted between the base 63 of the transistor 23 and the control circuit 34. Other parts of the circuit of the third embodiment are similar to those of the first embodiment. The starting circuit 55 consists of a transistor 51 and three resistors 52, 53 and 54. The emitter of the transistor 51 is connected to the positive terminal of the power source 35, and the collector is connected to the base 63 of the transistor 23 through the resistor 52. The starting circuit 55 issues starting pulses to the base of the transistor 23 during every closing period of the transistor 23, and stable and certain oscillation of the inverter circuit 66 is realized thereby. Since the starting base currents are less than the base current for the transistor 23, a small size transistor and small size resistors can be used for the transistor 23 and the resistor 52.

In FIG. 3, FIG. 5 and FIG. 6, the resonance capacitor 33 is connected in parallel to the transistor 23. Altanatively, it can be connected to the heating coil 22 in parallel.

Figure 7:
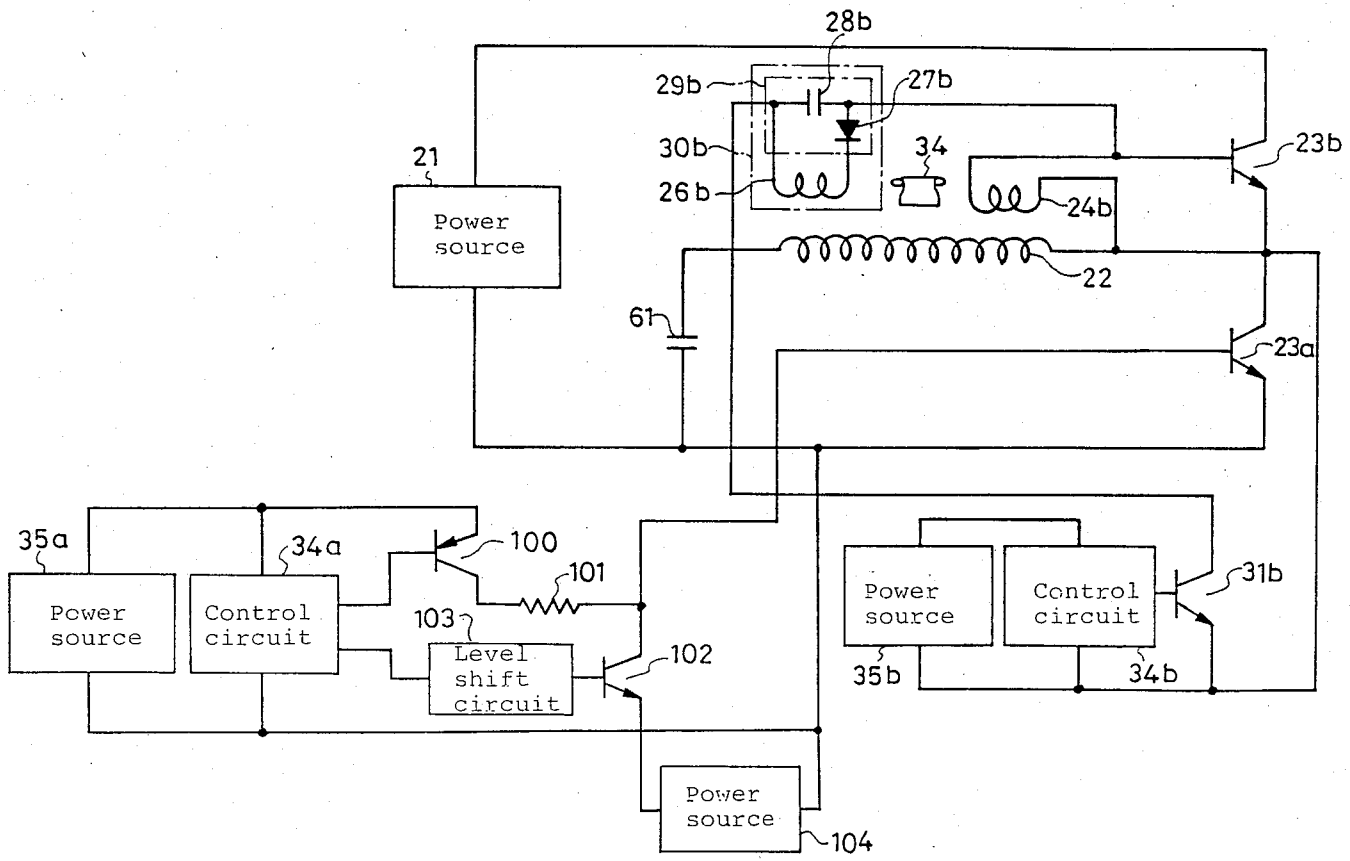
FIG. 7 is a circuit diagram of a fourth embodiment of the induction heating apparatus in accordance with the present invention.

The fourth embodiment of the induction heating apparatus in accordance with the present invention is shown in FIG. 7. Other parts of the circuit of the fourth embodiment are similar to those of the first embodiment. In this embodiment, a Half Bridge Inverter is formed by transistors **23*a* and 23*b*, a resonance capacitor 61 and a heating coil 22. A forward base current supplying circuit for the transistor 23*b* is formed by a first coupling coil 24*b* which is inductively coupled to the heating coil 22. An inverse bias voltage generating circuit 30*b* is formed by a second coupling coil 26*b*, a rectifier diode 27*b* and a capacitor 28*b* for a filter. A switching device 31*b* is controlled by a control circuit 34*b*. A power transistor 100 as a switching device controls the forward base current of the transistor 23*a*. A current restriction resistor 101 restricts the forward base current. A power source 104 supplys the inverse base voltage to the transistor 23*a*. A switching device 102 is driven by a level shift circuit 103 which shifts a level of an output signal from a control circuit 34***a*. The control circuit 34*a* synchronizes with the control circuit 34*b*, and conductive states of the transisters 23*a* and 23*b* are turned over alternately by the control of the control circuit 34*a* and 34*b*, respectively. Therefore, for example, when the transistor 23*a* is in ON state, the transistor 23*b* is in OFF state. Hence, the voltage which is applied to the transistor which is in OFF state does not exceed to the voltage of the power source 21, and an inexpensive transistor with a low breakdown voltage can be used.

Figure 8:
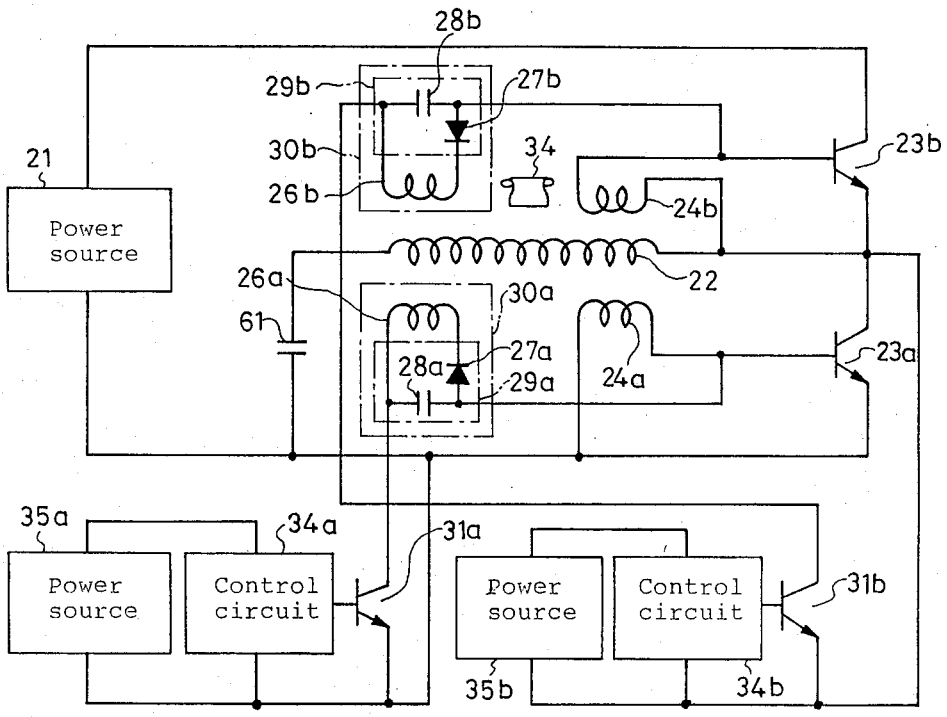
FIG. 8 is a circuit diagram of a fifth embodiment of the induction heating apparatus in accordance with the present invention.

A fifth embodiment of the induction heating apparatus in accordance with the present invention is shown in FIG. 8. The circuit of this embodiment comprise two control circuits 34*a*, 34*b*, two first coupling coils 24*a*, 24*b*, two second coupling coils 26*a*, 26*b* and two transistors 23*a*, 23*b*. Other parts of the circuit of the fifth embodiment are similar to those of the first embodiment. Two power sources 35*a* and 35*b* are connected to the control circuit 34*a* and the control circuit 34*b*, respectively. The emitter of the transistor 23*b* is connected to the collector of the transistor 23*a*. The collector of the transistor 23*b* is connected to the positive terminal of the power source 21 and the emitter of the transistor 23*a* is connected to the negative terminal. One of the terminals of the heating coil 22 is connected to the conjunction and the other terminal is connected to the negative terminal of the power source 21 through the resonance capacitor 61.

According to this embodiment, since the two transistors 23*a* and 23*b* are operated alternately, the features in the fourth embodiment are realized. Furthermore the switching device 100, the current restriction resistor 101, the level shifting circuit 103 and the power source 104 as shown in FIG. 7 are not required and a small size power source can be used. As a result, further simple, light weight high efficiency and inexpensive induction heating apparatus is realized.

As mentioned above, according to the present invention, two DC power sources for the driving circuits are supplied from the two coupling coils, and a switching device for controlling the forward base current and a current limitation resistor are not required.

Furthermore, a level shifting circuit for driving a switching device which controls an inverse bias for the transistor of the inverter circuit is not also required. As a result, the small size, light weight and low price induction heating apparatus is realized.

What is claimed is:

1. An induction heating apparatus comprising:

inverter means, including a heating coil and a transistor connected in series to a direct current power source, for converting said direct current into an alternating current;

forward base current supply means, connected to said transistor, for supplying a forward base current to said transistor such that when said base current is supplied to said transistor said transistor is turned on, and including a first coupling coil inductively coupled to said heating coil;

inverse bias voltage generating means, including a second coupling coil inductively coupled to said heating coil, for causing a negative voltage at the base of said transistor such that when said negative voltage is present said transistor is turned off, and further including a rectifier and a filter;

switching means, connected to and for switching said forward base current means and said inverse bias voltage generating means, so as to thereby turn on and off respectively said transistor; and a control means, connected to and for controlling said switching means.

2. An induction heating apparatus in accordance with claim 1, wherein said forward base current supply means is connected between the base and the emitter of said transistor.

3. An induction heating apparatus in accordance with claim 1, wherein said switching means has two terminals and said inverse voltage generating means is connected between the base of said transistor and a first terminal of said switching means, and second terminal of said switching means is connected to the emitter of said transistor.

4. An induction heating apparatus in accordance with claim 1, wherein said first coupling coil is used as a current transformer, and said second coupling coil is used as a voltage transformer.

5. An induction heating apparatus in accordance with claim 1, wherein said forward base current supply includes a diode which is series connected to said first coupling coil.

6. An induction heating apparatus comprising:

inverter means, including a heating coil, a first transistor, and a second transistor, wherein said transistors are connected in series and said heating coil is connected between the junction of said transistors and a direct current power source, for converting said direct current from said direct current power source into an alternating current;

first forward base current supply means, including a first coupling coil coupled to said heating coil inductively and connected to said first transistor, for supplying a forward base current to said first transistor which turns said transistor on;

first inverse bias voltage generating means, including a second coupling coil coupled to said heating coil inductively and including a filter and a rectifier, for causing a negative voltage at the base of said first transistor such that when said negative voltage is present said first transistor is turned off;

a first switching means, connected to and for switching said first forward base current means and said first inverse bias voltage generating means, so as to turn on and off respectively said first transistor;

second forward bias generating means, connected to said second transistor, for supplying a forward base current to said second transistor, such that when said current is supplied said second transistor is turned on;

second inverse bias generating means, connected to said second transistor, for supplying a negative voltage to the base of said second transistor such that when said negative voltage is present said second transistor is turned off;

second switching means, connected to and for switching said second forward bias generating means and said second inverse bias generating means, so as to turn on and turn off respectively said second transistor;

control means, connected to and for controlling said first and second switching means, such that said first and second transistors are turned on and off in an opposite manner.

7. An induction heating apparatus in accordance with claim 6, wherein said first forward base current supply means is connected between the base and the emitter of said first transistor.

8. An induction heating apparatus in accordance with claim 6, wherein said first switching means has two terminals and said first bias voltage generating means is connected between the base of said first transistor and the first terminal of said first switching device, and the second terminal of said first switching means is connected to the emitter of said first transistor.

9. An induction heating apparatus in accordance with claim 6, wherein said first coupling coil is used as a current transformer, and said second coupling coil is used as a voltage transformer.

10. An induction heating apparatus comprising:

inverter means including a heating coil, a first transistor, and a second transistor wherein said transistors are connected in series and said heating coil is connected between the junction of said transistors and a direct current power source, for converting said direct current into an alternating current, first forward base current supply means, having a first coupling coil coupled to said heating coil inductively and connected to the base of said first transistor, for supplying a forward base current to said first transistor which turns said transistor on;

(a) first inverse bias voltage generating means, including a second coupling coil coupled to said heating coil inductively, and further including a rectifier and a filter, for causing a negative voltage at the base of said first transistor so that when said voltage is present said transistor is turned off;

(b) first switching means, connected to and for switching said first forward base current supply means and said first inverse voltage generating means so as to turn on and off respectively and first transistor;

a second forward base current supply means, having a third coupling coil coupled to said heating coil inductively and connected to the base of said second transistor, for supplying a forward base current to said second transistor which turns said transistor on;

second inverse bias voltage generating means, having a filter and a rectifier and a fourth coupling coil coupled to said heating coil inductively, for causing a negative voltage at the base of said second transistor so that when said voltage is present said transistor is turned off;

second switching means, connected to and for switching said second forward base current supply means and said second inverse voltage supply means so as to turn on and off respectively said second transistor;

control means, connected to and for switching said first and second switching means and said first and second inverse bias voltage generating means so as to turn said first and second transistors on and off respectively in an opposite manner.

11. An induction heating apparatus in accordance with claim 10, wherein said first forward base current supply means is connected between the base and the emitter of said first transistor.

12. An induction heating apparatus in accordance with claim 10, wherein said first switching means has two terminals and said first inverse bias voltage generating means is connected between the base of said first transistor and the first terminal of said first switching means, and the second terminal of said first switching means is connected to the emitter of said first transistor.

13. An induction heating apparatus in accordance with claim 10, wherein said second forward base current supply means is connected between the base and the emitter of said second transistor.

14. An induction heating apparatus in accordance with claim 10, wherein said second switching means has two terminals and said second inverse bias voltage generating means is connected between the base of said second transistor and the first terminal of said second switching means, and a second terminal of said second switching means is connected to the emitter of said second transistor.

15. An induction heating apparatus in accordance with claim 10, wherein said first and third coupling coils coupling coils are used as current transformers, and said second and fourth coupling coils are used as voltage transformers.

16. An induction heating apparatus in accordance with claim 1, 6, or 10, wherein said control means includes starting means for starting alternating current flow in said inverter.

17. An induction heating apparatus in accordance with claim 16, wherein said starting means issues starting currents for every conductive state of said transistor or transistors.

* * * * *